US006093515A

United States Patent [19]

Yoshida et al.

[11] Patent Number: 6,093,515

[45] Date of Patent: Jul. 25, 2000

[54] ELECTROPHOTOGRAPHIC PHOTOSENSITIVE MEMBER, PROCESS CARTRIDGE AND ELECTROPHOTOGRAPHIC APPARATUS

[75] Inventors: Akira Yoshida; Hideki Anayama, both of Yokohama, Japan

[73] Assignee: Canon Kabushiki Kaisha, Tokyo, Japan

[21] Appl. No.: 09/141,416

[22] Filed: Aug. 27, 1998

[30] Foreign Application Priority Data

Aug. 29, 1997 [JP] Japan ..... 9-233950

[51] Int. Cl.[7] ..... G03G 5/04

[52] U.S. Cl. ..... 430/96; 399/159

[58] Field of Search ..... 430/48, 58, 59, 430/66, 96; 399/159

[56] References Cited

U.S. PATENT DOCUMENTS

| | | | |
|---|---|---|---|
| 3,837,851 | 9/1974 | Shattuck et al. | 96/1.5 |
| 3,871,880 | 3/1975 | Montillier | 96/1.5 |
| 5,080,987 | 1/1992 | Odell et al. | 430/58.8 |
| 5,208,127 | 5/1993 | Terrell et al. | 430/66 |
| 5,254,423 | 10/1993 | Mayama et al. | 430/58 |
| 5,418,099 | 5/1995 | Mayama et al. | 430/58 |
| 5,538,826 | 7/1996 | Ainoya et al. | 430/58 |

FOREIGN PATENT DOCUMENTS

| | | |
|---|---|---|
| 0570908A1 | 11/1993 | European Pat. Off. . |
| 167759 | 12/1981 | Japan . |
| 19576 | 2/1982 | Japan . |
| 228453 | 10/1986 | Japan . |
| 272754 | 12/1986 | Japan . |
| 72753 | 3/1993 | Japan . |
| 136108 | 5/1994 | Japan . |

OTHER PUBLICATIONS

Patent Abstracts of Japan, vol. 017, No. 557 (P–1626), Oct. 1993 for JP 05–158249.

Patent Abstracts Japan, vol. 018, No. 591 (C–1272), Nov. 1994 for JP 06–220181.

*Primary Examiner*—John Goodrow

*Attorney, Agent, or Firm*—Fitzpatrick, Cella, Harper & Scinto

[57] ABSTRACT

An electrophotographic photosensitive member, comprising a support and a photosensitive layer disposed on the support. The photosensitive member has a surface layer comprising a siloxane polymer which comprises at least two polysiloxane units each independently represented by a formula (1) (shown in the specification) and has a molecular structure such that adjacent two polysiloxane units of the formula (1) are connected with each other at their side chains by —O—Pc—CO—O— where Pc denotes a polycarbonate chain. Such a molecular structure of the siloxane polymer is effective in improving lubricating properties of the surface of the photosensitive member while retaining a mechanical strength thereof.

7 Claims, 1 Drawing Sheet

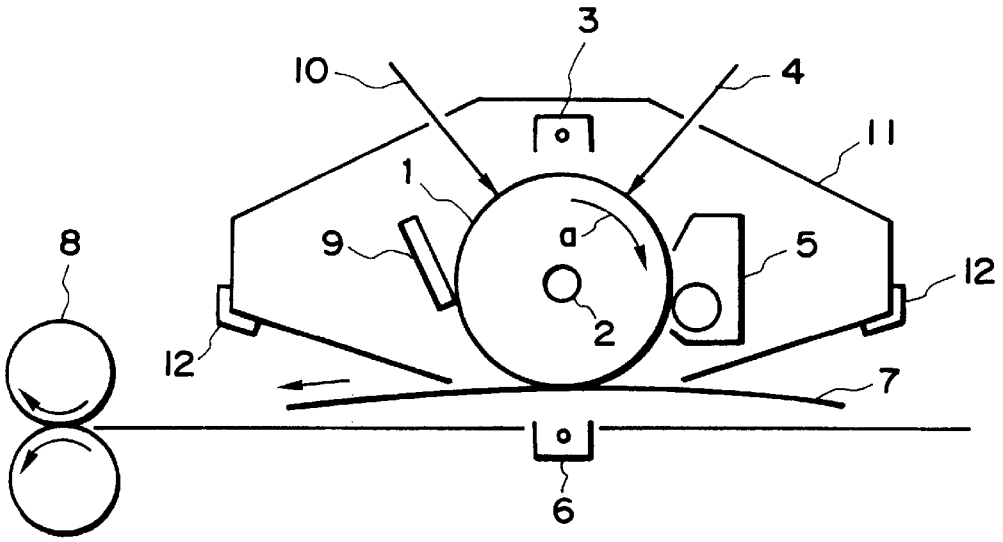
3
10
4
11
1
a
9
5
8
12
2
12
7
6

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member, particularly an electrophotographic photosensitive member having a surface layer comprising a specific (siloxane) polymer, a process cartridge including the photosensitive member, and an electrophotographic apparatus using the photosensitive member.

In recent years, there have been developed electrophotographic photosensitive members utilizing various organic photoconductive compounds. For instance, there have been proposed a photosensitive member having a charge transport layer comprising triarylpyrazoline as described in U.S. Pat. No. 3,837,851 and a photosensitive member having a charge generation layer comprising a perylene pigment derivative and a charge transport layer as described in U.S. Pat. No. 3,871,880.

Such organic photoconductive compounds have different sensitive wavelength regions depending on the compounds used. In this regard, Japanese Laid-Open Patent Applications (JP-A) 61-272754 and 56-167759 disclose (organic photoconductive) compounds showing a high (photo-) sensitivity in a visible (wavelength) region. Furthermore, JP-A 57-19576 and JP-A 61-228453 disclose compounds showing a sensitive wavelength region extending in an infrared (wavelength) region. The compounds (materials) that show a sensitivity in the infrared region are suitable for use in laser beam printers and LED (light-emitting diode) printers and have been employed more frequently in recent years.

The photosensitive member is generally required to have good characteristics in terms of a sensitivity, electrical characteristics, mechanical characteristics and optical characteristics. Particularly, when the photosensitive member is repetitively used, electrical and mechanical external forces are directly exerted on the surface of the photosensitive member during a sequence of, for exapmle, charging-exposure-developing-transfer-cleaning in an ordinary electrophotographic process. As a result, the surface layer of the photosensitive member is required to be durable against external forces, such as a deterioration due to ozone and nitrogen oxides generated in the charging step and electrical and mechanical deteriorations due to surface abrasion and/or mars caused by charging (discharging) and/or cleaning. For this reason, in order to improve durabilities of a photosensitive member with an organic surface layer, which generally has a relatively low hardness, it is important to have good surface lubricating properties (surface lubricity) and a large mechanical strength of a resin used.

For improvement in lubricating properties, there have been proposed polycarbonate copolymers having a polysiloxane changing their main chains as described in JP-A 5-72753 and JP-A 6-136108.

However, when the polycarbonate copolymer having a main chain including a polysiloxane structure is used to improve the lubricity, the resultant polycarbonate copolymer has been liable to lower a good mechanical strength of a polycarbonate resin (homopolymer) in some cases although a degree of lowering in mechanical strength varies depending on a proportion of the polysiloxane structure. Furthermore, the surface abrasion is governed by a relationship between the strength and lubricity of the surface layer, so that an improvement in surface lubricity and a limitation on lowering the strength of a resin for the surface layer must be satisfied simultaneously in order to improve the durabilities of the photosensitive member.

The photosensitive member before driven or actuated has a very smooth and even surface, possessing high adhesive properties with a cleaning blade. After being driven once, it has a roughened surface due to abrasion of the surface layer and is somewhat improved in surface lubricity between the photosensitive member surface and the cleaning blade due to the presence of toner particles and/or abraded powder. Accordingly, unless an initial lubricity of the surface layer used was high, the resultant photosensitive member is liable to experience problems such as blade inversion and blade noise. These problems are particularly noticeable in a high-humidity environment because of an increased friction coefficient.

Furthermore, the improved lubricity of the surface layer of the photosensitive member is also effective in suppressing adhesion of-toner particles and paper dust, thus preventing not only the shortened life (of the photosensitive member) due to the abrasion of the surface layer but also the shortened life due to image formation failure caused by, for example, the attachment to the photosensitive member.

SUMMARY OF THE INVENTION

An object of the present invention is to provide an electrophotographic photosensitive member having excellent lubricity and surface strength thereby promoting a prolonged life and high-quality images.

Another object of the present invention is to provide a process cartridge including the photosensitive member and an electrophotographic apparatus including the photosensitive member.

According to the present invention, there is provided an electrophotographic photosensitive member, comprising: a support and a photosensitive layer disposed on the support, wherein said photosensitive member has a surface layer comprising a siloxane polymer which comprises at least two polysiloxane units each independently represented by a formula (1) shown below and has a molecular structure such that adjacent two polysiloxane units of the formula (1) are connected with each other at their side chains by —O—Pc—CO—O— where Pc denotes a polycarbonate chain:

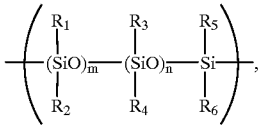

(1)

wherein $R_1$, $R_2$, $R_5$ and $R_6$ independently denote hydrogen, halogen, a substituted or unsubstituted alkyl group, or a substituted or unsubstituted aryl group;

$R_3$ and $R_4$ independently denote hydrogen, halogen, substituted or unsubstituted alkyl group, substituted or unsubstituted aryl group, or a divalent group represented by the following formula (2):

(2)

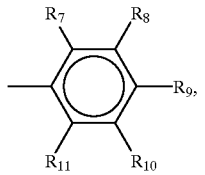

wherein $R_7$ to $R_{11}$ independently denote a single bond, hydrogen, halogen, substituted or unsubstituted alkyl group, or substituted or unsubstituted aryl group; one of $R_7$ to $R_{11}$ being a single bond and at least one of $R_3$ and $R_4$ groups connected with $(SiO)_n$ being said divalent group of the formula (2); and m and n independently denote a positive integer.

According to the present invention, there is also provided a process cartridge detachably mountable on an electrophotographic apparatus main body, comprising the above-mentioned an electrophotographic photosensitive member and at least one means selected from the group consisting of charging means, developing means and cleaning means.

According to the present invention, there is further provided an electrophotographic apparatus comprising the above-mentioned electrophotographic photosensitive member, charging means, exposure means, developing means and transfer means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

The sole FIGURE is a schematic sectional view of an embodiment of an electrophotographic apparatus including a process cartridge using an electrophotographic photosensitive member according to the present invention.

DETAILED DESCRIPTION OF THE INVENTION

In the present invention, an electrophotographic photosensitive member is characterized by a surface layer comprising a branched or non-linear siloxane polymer which comprises at least two polysiloxane units each independently represented by the formula (1) shown hereinabove and has a molecular structure such that adjacent two polysiloxane units of the formula (1) are connected with each other at their side chains by —O—Pc—CO—O— where Pc denotes a polycarbonate chain.

In the formulas (1) and (2), examples of a halogen for the groups $R_1$ to $R_{11}$ may include fluorine, chlorine and bromine. Examples of an alkyl group therefor may include methyl, ethyl, propyl and butyl. Examples of an aryl group may include phenyl and naphthyl.

Examples of a substituent for the above-mentioned alkyl group and aryl group may include: an alkyl group, such as methyl, ethyl, propyl or butyl; an aryl group, such as phenyl or naphthyl; and a halogen, such as fluorine, chlorine or bromine.

In the formula (1), two or more species of the siloxane unit

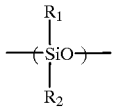

may be co-present in one molecule. Specifically, $R_1$ and $R_2$ may independently be different for each siloxane unit.

Furthermore, m and n in the formula (1) may preferably satisfy m+n=2–200, more preferably m+n=10–100. If the sum of m and n is below 2, a sufficient lubricity of the surface layer is not readily obtained. If the sum of m and n exceeds 200, a sufficient mechanical strength of the surface layer is not readily obtained.

In the formula (1), the polycarbonate chain Pc is a polymer chain having a carbonate linkage (—O—CO—O—) and may preferably have a recurring unit represented by the following formula (3):

(3)

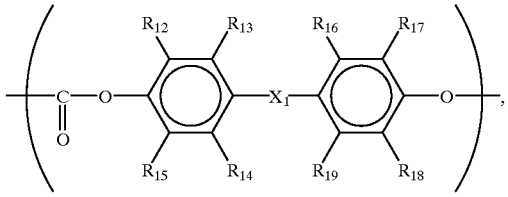

wherein $X_1$ denotes a single bond, —O—, —S—, or substituted or unsubstituted alkylidene group; and $R_{12}$ to $R_{19}$ independently denote hydrogen, halogen, substituted or unsubstituted alkyl group, or substituted or unsubstituted aryl group.

In the formula (3), the single bond for $X_1$ means that tw (substituted) benzene rings are directly connected with each other. Examples of alkylidene group for $X_1$ may include an ethylidene group, an isopropylidene group, a cyclopentylidene group and cyclohexylidene group. Examples of a halogen, an alkyl group and an aryl group for $R_{12}$ to $R_{19}$ may be those as described for the formulas (1) and (2), respectively.

Examples of a substituent for the above-mentioned alkylidene group, alkyl group and aryl group may include: an alkyl group, such as methyl, ethyl, propyl or butyl; an aryl group, such as phenyl or naphthyl; and a halogen, such as fluorine, chlorine or bromine.

In the present invention, two adjacent polysiloxane units of the formula (1) are connected with each other at their side chains by —O—Pc—CO—O— as described above. In this instance, each side chain for the two adjacent polysiloxane units may include a divalent group of the formula (2) as at least one of $R_3$ and $R_4$ groups connected with $(SiO)_n$ and is connected with —O—Pc—CO—O— via one of the single bonds of the divalent group, thus forming the above-mentioned molecular structure of the siloxane polymer.

In view of the lubricity, the number of the group —O—Pc—CO—O— may preferably be not greater than 10 for the siloxane polymer.

The siloxane polymer used in the present invention may preferably be synthesized by using a siloxane compound represented by a formula (4) shown below, a bisphenol compound represented by a formula (5) shown below, and phosgene:

(4)

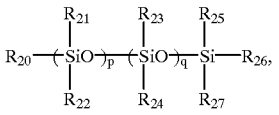

wherein $R_{20}$ to $R_{27}$ independently denote hydrogen, halogen, a substituted or unsubstituted alkyl group, or a substituted or unsubstituted aryl group, at least one of $R_{23}$ and $R_{24}$ groups connected with $(SiO)_q$ being substituted or unsubstituted phenyl group having hydroxyl group, and p and q independently denote a positive integer; and (5)

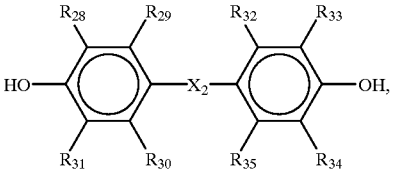

wherein $X_2$ denotes a single bond, —O—, —S—, a substituted or unsubstituted alkylidene group; and $R_{28}$ to $R_{35}$ independently denote hydrogen, halogen, a substituted or unsubstituted alkyl group, or a substituted or unsubstituted aryl group.

In the above formulas (4) and (5), examples of the respective groups (halogen, alkyl group, aryl group, single bond, and alkylidene group) and their substituents may be identical to those described above for the corresponding groups in the formulas (1), (2) and (3), respectively.

In the formula (4), similarly to formula (1), two or more species of the siloxane unit

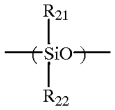

may be co-present in one molecule. Specifically, $R_{21}$, and $R_{22}$ may independently be different for each siloxane unit.

Preferred specific examples of the siloxane compound of the formula (4) and the bisphenol compound of the formula (5) are shown below by their structural formulas, respectively. The siloxane and bisphenol compounds of the formulas (4) and (5) used in the present invention, however, should be understood not to be limited to these specific examples, respectively.

Siloxane compound of the formula (4)

(4-1)

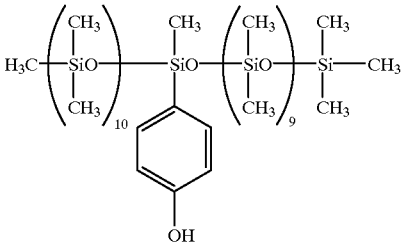

(4-2)

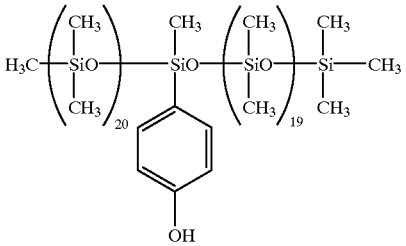

(4-3)

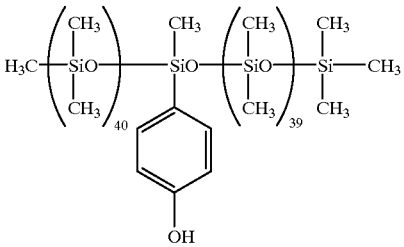

(4-4)

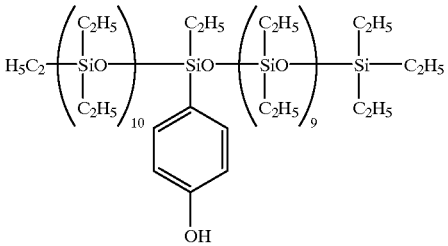

(4-5)

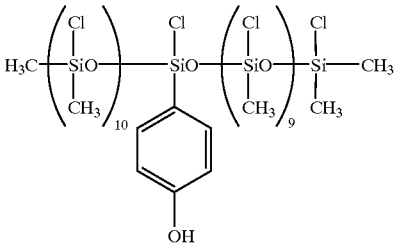

(4-6)

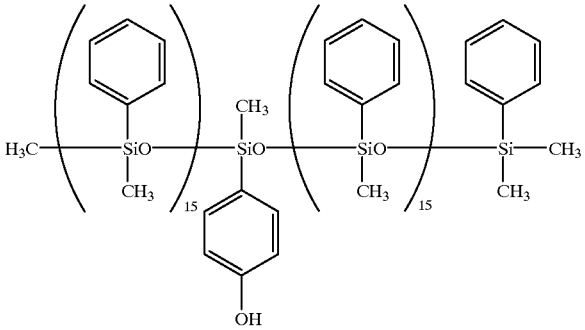

-continued
(4-7)
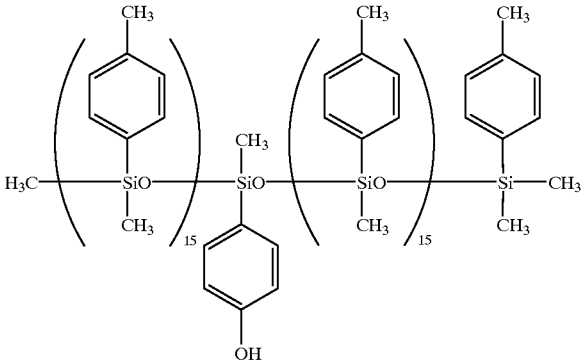
(4-8)
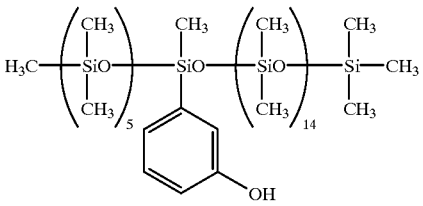
(4-9)
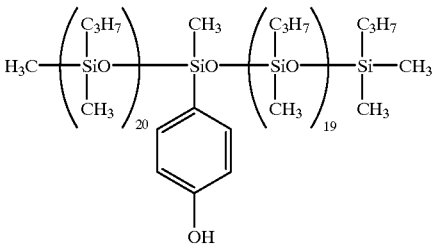
(4-10)
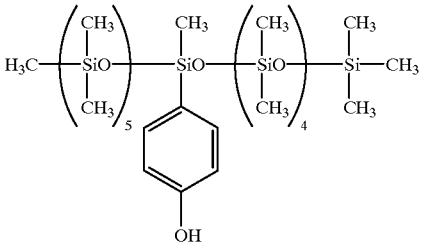
(4-11)
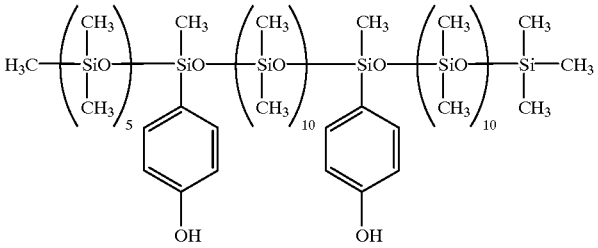
(4-12)
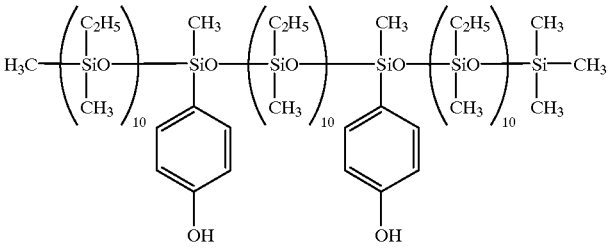

-continued
(4-13)
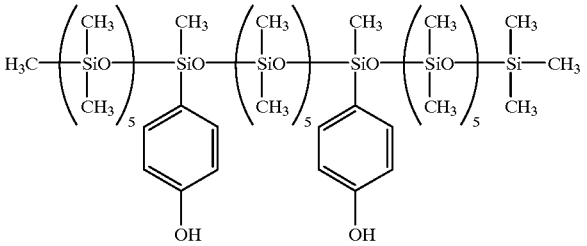
(4-14)
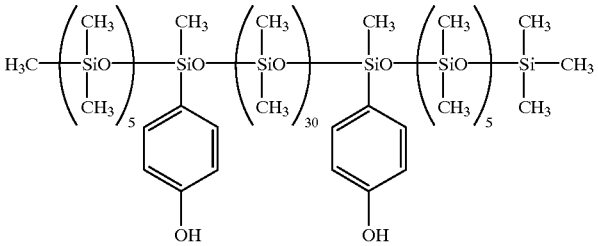
(4-15)
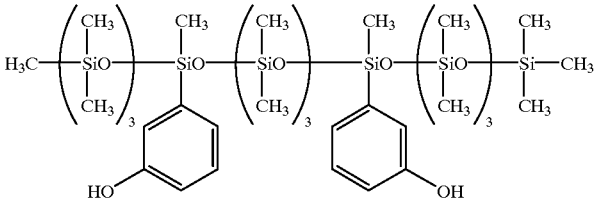
(4-16)
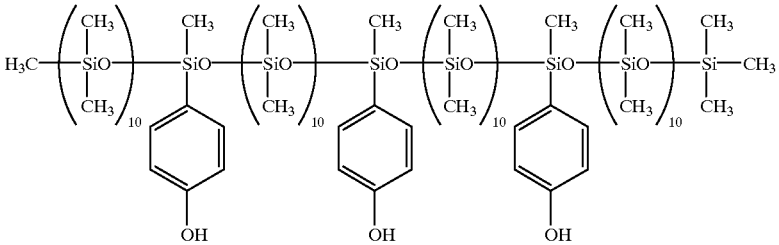
(4-17)
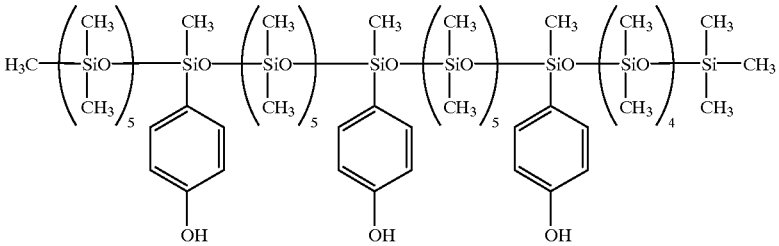
(4-18)
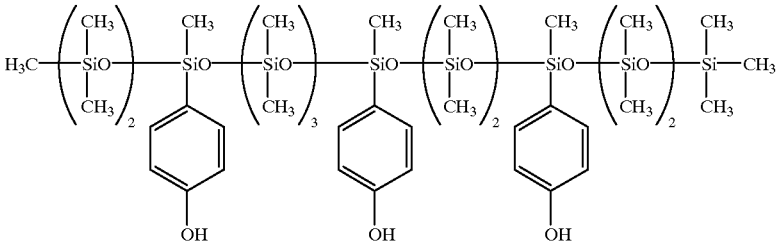

-continued
(4-19)
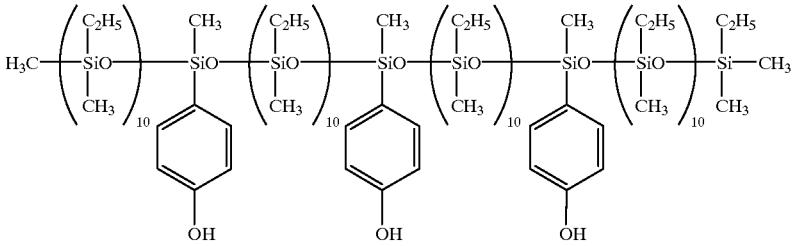
(4-20)
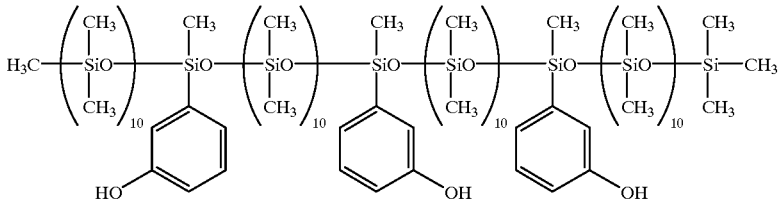
(4-21)
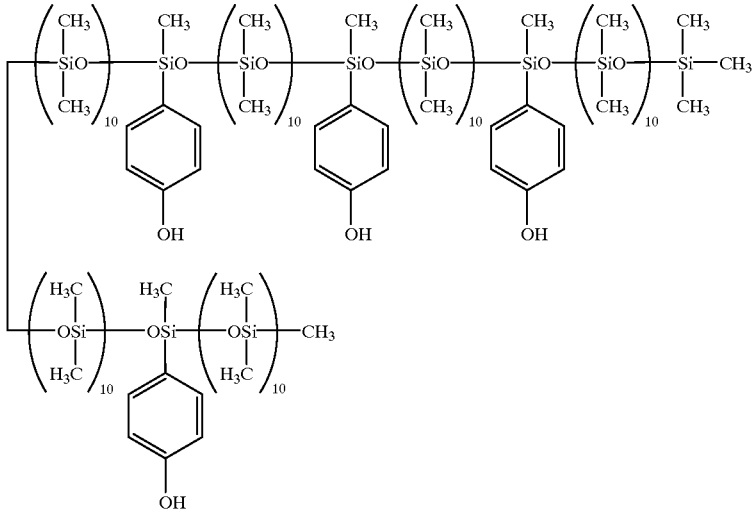
(4-22)
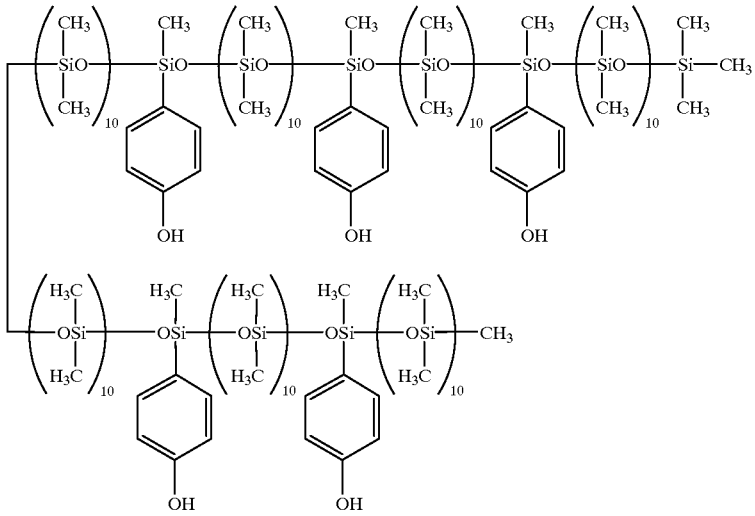

-continued
(4-23)
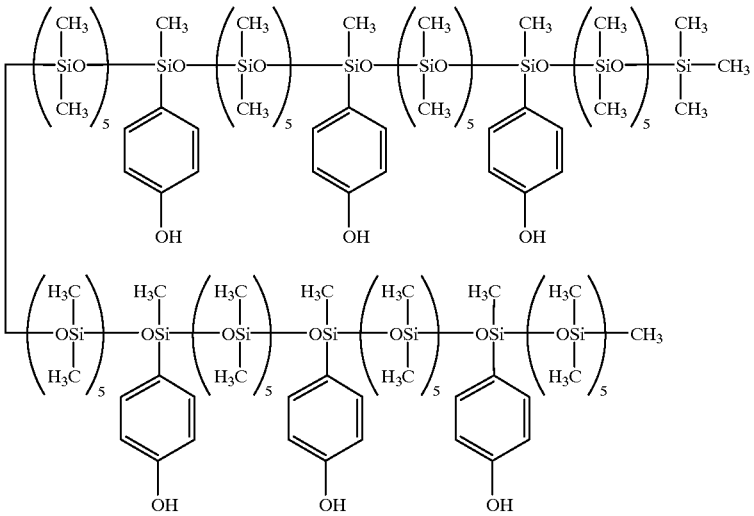
(4-24)
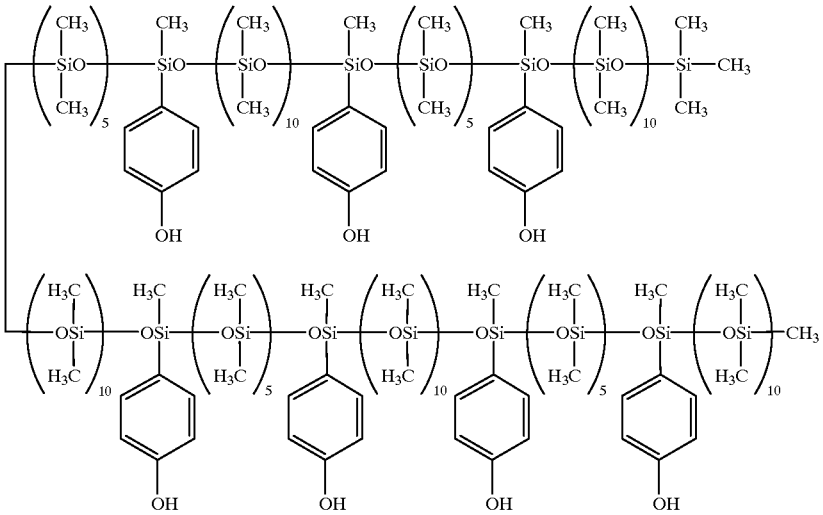
Bisphenol compound of the formula (5)
(5-1)
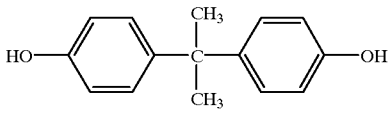
(5-2)
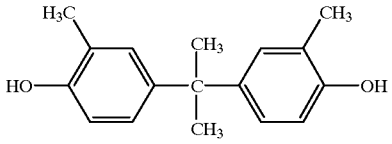
-continued
(5-3)
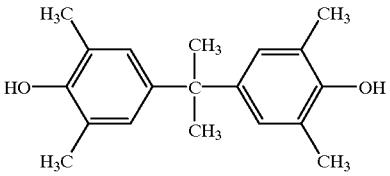
(5-4)
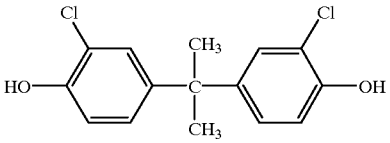

-continued
(5-5)
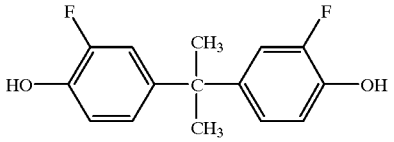
(5-6)
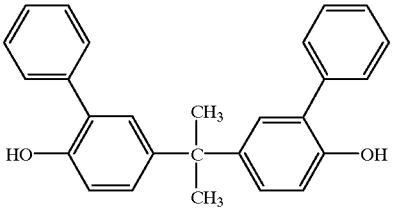
(5-7)
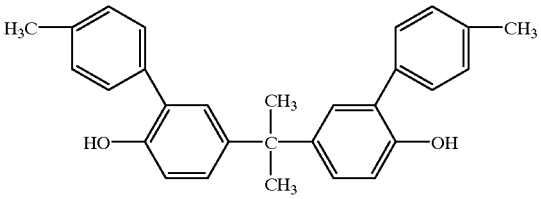
(5-8)
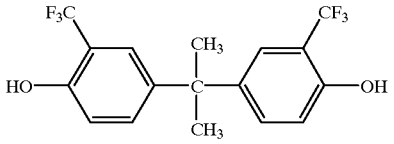
(5-9)
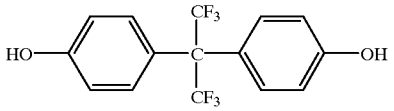
(5-10)
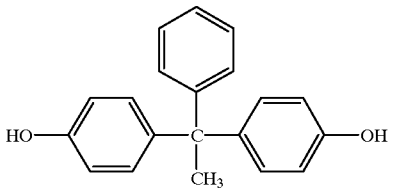
(5-11)
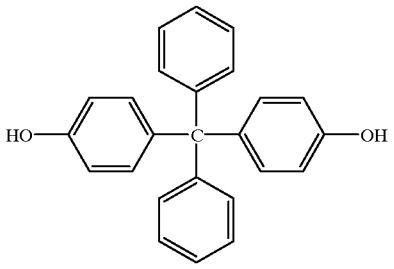
-continued
(5-12)
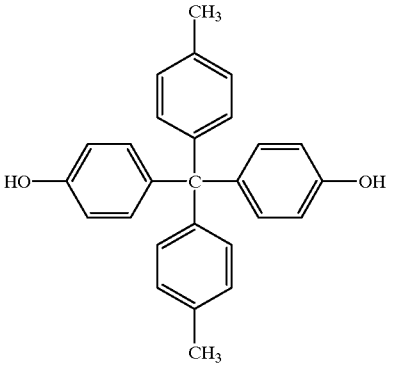
(5-13)
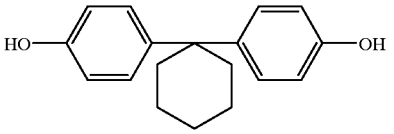
(5-14)
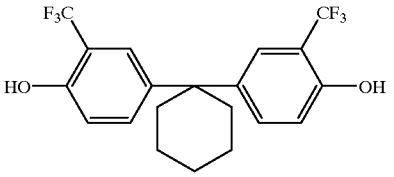
(5-15)
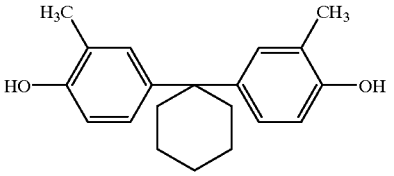
(5-16)
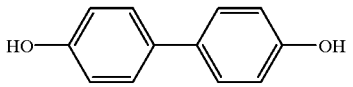
(5-17)
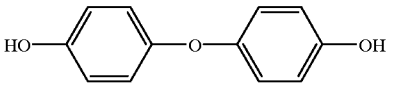
(5-18)
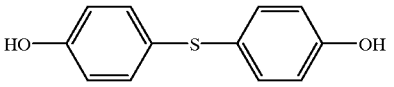
Of the above-enumerated siloxane compound of the formula (4) and the bisphenol compound of the formula (5), those of the formulas (4-1), (4-2), (4-11), (4-12) and (4-16) and those of the formulas (5-1), (5-2) and (5-13) may more preferably be used.
The siloxane polymer used in the present invention may, for example, be specifically by synthesized in the following manner.

SYNTHESIS EXAMPLE 1

In 500 m of 10%-sodium hydroxide aqueous solution, 134 g (0.5 mol) of a bisphenol compound of the formula (5-13) was added and dissolved to the solution, 300 ml of dichloromethane was added. Under stirring at 10–15° C. (solution temperature), 100 g of phosgene was introduced into the resultant mixture in 1 hour. After about 70% of the phosgene introduction, 24.2 g (0.015 mol) of a siloxane compound of the formula (4-1) was added to the mixture. After the complete phosgene introduction, the mixture was vigorously stirred and thereto, 0.2 ml of triethylamine was added thereto, followed by further stirring for 1 hour. Then, the resultant dichloromethane phase was neutralized with phosphoric acid and repetitively washed with water until the phase showed a pH of about 7. This liquid phase was added dropwise to isopropyl alcohol to obtain a precipitate. The precipitate was recovered by filtration and dried to obtain a white powdery polymer (a siloxane polymer used in the present invention).

As a result of infrared spectroscopic analysis of the resultant polymer, an absorption peak derived from the carbonyl group was observed at 1750 $cm^{-1}$ and an absorption peak derived from ether bond was confirmed in the position of 1240 $cm^{-1}$, thus confirming the presence of a carbonate bond. In an absorption band of 1100–1000 $cm^{-1}$, an absorption peak derived from siloxane was also confirmed. Further, there was little or no absorption peak in an absorption band of 3650–3200 $cm^{-1}$, thus confirming little or no hydroxyl group.

The polymer had a viscosity-average molecular weight (Mv) of about 22,000.

Thus, the polymer was identified as a siloxane polymer with the following structural formula.

SYNTHESIS EXAMPLE 2

A siloxane polymer was prepared in the same manner as in Synthesis Example 1 except that the siloxane compound of the formula (4-1) was changed to 39.2 g (0.015 mol) of a siloxane compound of the formula (4-11) and 0.1 g of t-butyl phenol was used as a molecular weight-controlling agent.

The resultant polymer had an Mv of about 25,000 and was formed to have the following structural formula through the infrared spectroscopic analysis similarly as in Synthesis Example 1.

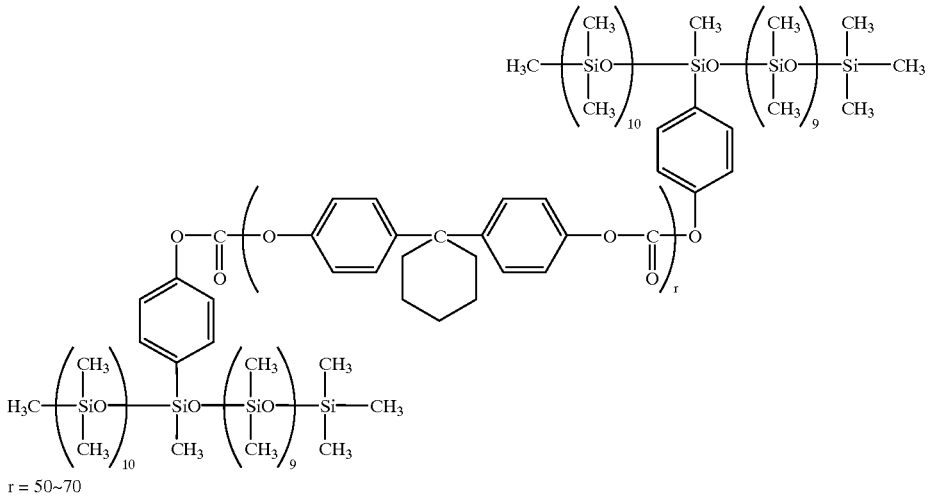

r = 50~70

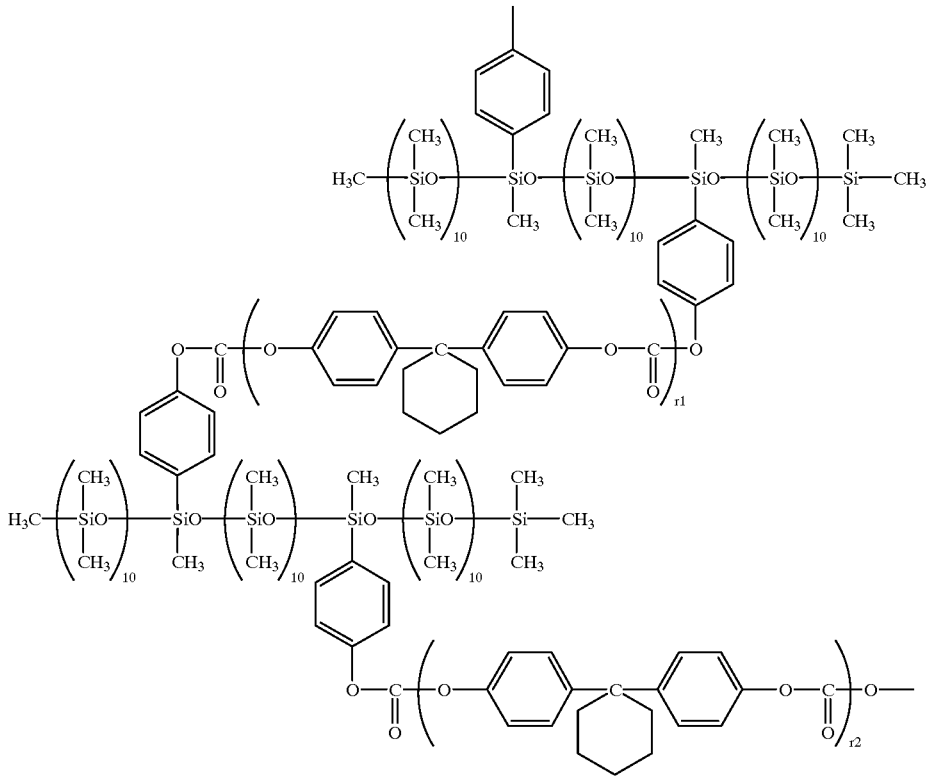

r1 + r2 + … rx = 50~70

In the present invention, the siloxane polymer used may preferably have a viscosity-average molecular weight (Mv) of 10,000–200,000, particularly 15,000–100,000.

In a preferred embodiment, the siloxane polymer is used in mixture with another resin having a larger (mechanical) strength although it per se has excellent lubricity and strength. The siloxane polymer may preferably be mixed with another resin in a proportion by weight (siloxane polymer: another resin) of 1:1–99, particularly 1:2–30.

In the case where a siloxane polymer used in the present invention has a molecular structure such that one polysiloxane unit is connected with —O—Pc—CO—O— at its one side chain, like in the polymer prepared in Synthesis Example 1, the siloxane polymer has a very high lubricity and accordingly it can be used in a smaller amount when mixed with another resin, without lowering the strength of another resin.

In the case of a siloxane polymer with such a molecular structure that one polysiloxane unit is connected with —O—Pc—CO—O— at its two (opposite) side chains, like in the polymer prepared in Synthesis Example 2, the siloxane polymer has a small surface migration in addition to the improved lubricity, thus considerably prolonging the effect of the lubricity even in mixture with another resin.

Another resin described above may preferably be a polycarbonate resin, which may more preferably have a recurring unit represented by the following formula (6):

(6)

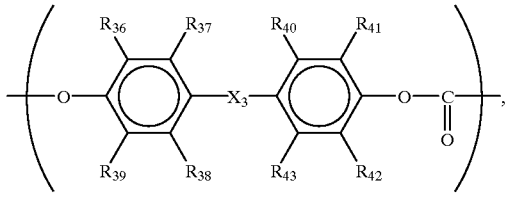

wherein $X_2$ denotes a single bond, —O—, —S—, a substituted or unsubstituted alkylidene group; and $R_{28}$ to $R_{35}$ independently denote hydrogen, halogen, a substituted or unsubstituted alkyl group, or a substituted or unsubstituted aryl group.

In the above formula (6), examples of the respective groups (halogen, alkyl group, aryl group, single bond, and alkylidene group) and substituents therefor may be identical to those described above for the corresponding groups in the formula (3).

Preferred specific examples of the polycarbonate resin of the formula (4) as another resin are shown below by their recurring units. The polycarbonate resin of the formula (6) used in the present invention, however, should be understood not to be limited to these specific examples.

Polycarbonate resin of the formula (6)
(6-1)
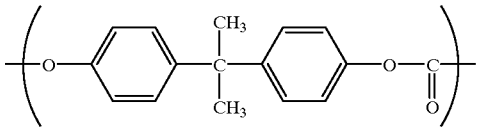
(6-2)
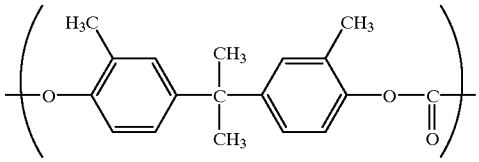
(6-3)
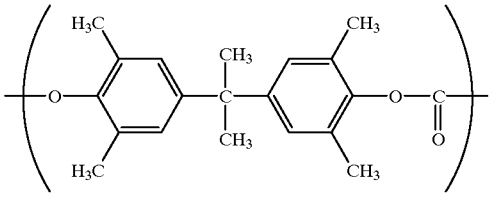
(6-4)
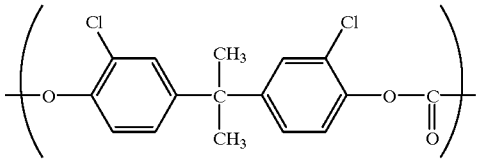
(6-5)
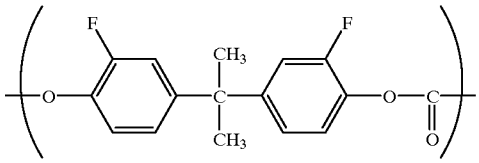
(6-6)
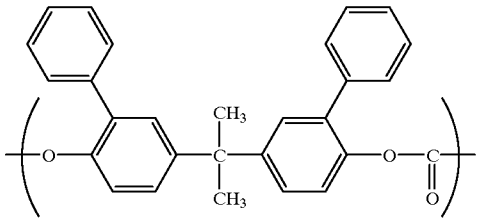
(6-7)
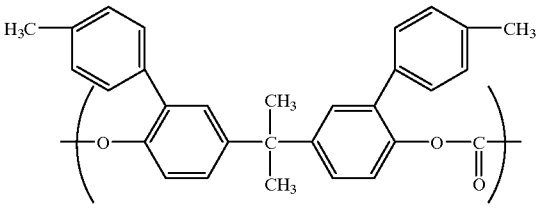
-continued
(6-8)
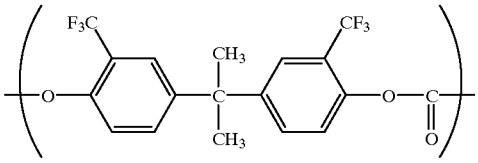
(6-9)
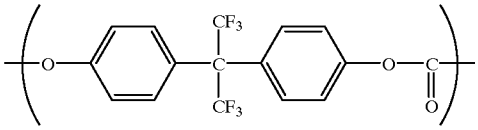
(6-10)
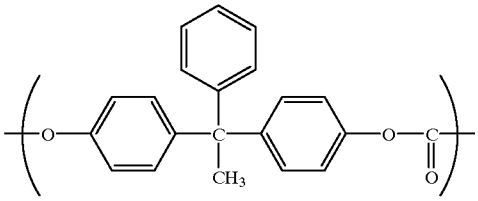
(6-11)
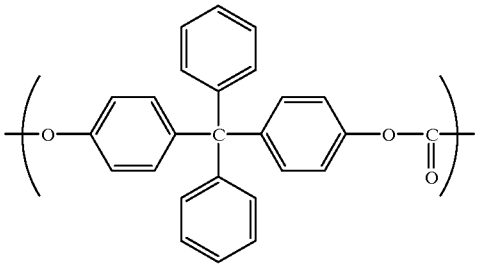
(6-12)
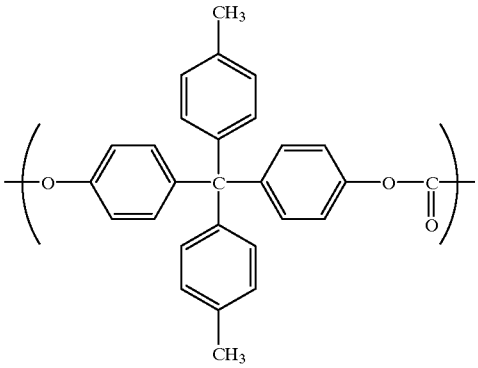
(6-13)
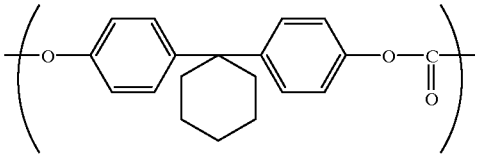

-continued (6-14)

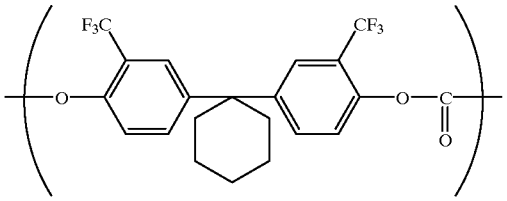

(6-15)

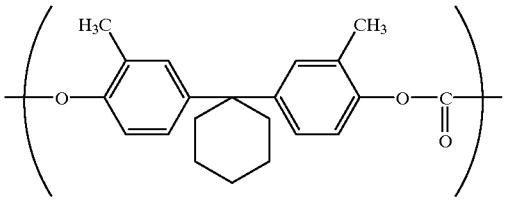

(6-16)

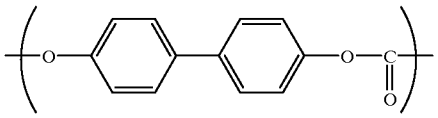

(6-17)

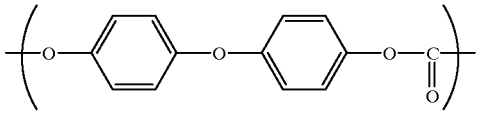

(6-18)

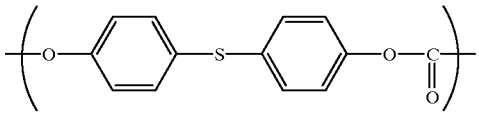

Among the above polycarbonate resins, those represented by the formulas (6-1), (6-2) and (6-13) may preferably be used.

The electrophotographic photosensitive member according to the present invention may have a photosensitive layer of a single layer-type wherein a charge-transporting material and a charge-generating material are contained in a single layer and a photosensitive layer of a lamination-type wherein a charge transport layer containing a charge-transporting material is formed on a charge generation layer containing a charge-generating material. In view of electrophotographic characteristics, the photosensitive member may more preferably have the lamination-type photosensitive layer.

In the present invention, the surface layer of the photosensitive member corresponds to the photosensitive layer of the single layer-type or the charge transport layer of the lamination-type photosensitive layer. The surface layer may be a protective layer formed on the photosensitive layer. The protective layer may include electroconductive particles of, for example, metal oxides.

The charge transport layer may be formed by applying (wet-coating) a solution of the siloxane polymer (as a binder resin) and the charge-transporting material and another binder resin (e.g., the polycarbonate resin of the formula (6)) as desired, in an appropriate solvent and drying the resultant wet coating. Examples of the charge-transporting material may include a triarylamine compound, a hydrazone compound, a stilbene compound, a pyrazoline compound, an oxazole compound, a triarylmethane compound and a thiazole compound. The charge-transporting material and the binder resin (including another binder resin) may preferably be mixed in a weight ratio of 1:0.5 to 1:2. The thus formed charge transport layer may preferably have a thickness of 5–40 μm, more preferably 15–30 μm.

The charge generation layer may be formed by applying a dispersion prepared by dispersing a mixture of the charge-generating material, a binder resin (in an amount 0.3–4 times that of the charge-generating material) in a dispersion means (such as a homogenizer, an ultrasonic dispersion mill, a ball mill, a vibration ball mill, a sand mill, an attritor, a roll mill, and a high-speed dispersion machine of a liquid impingement-type and drying the resultant wet coating. Examples of the charge-generating material may include selenium-tellurium, pyrilium or thiopyrilium dyes, phthalocyanine pigments anthoanthrone pigments, dibenzopyrenequinone pigments, trisazo pigments, cyanine dyes, disazo pigments, monoazo pigments, indigo pigments, quinacridone pigments and asymmetric quinocyanine pigments. The thus formed charge generation layer may preferably have a thickness of at most 5 μm, more preferably 0.1–2 μm.

The single layer-type photosensitive layer may be formed by applying a coating liquid prepared by dispersing or dissolving the above-mentioned charge-generating and charge-transporting material in the above-mentioned binder resins and drying the resultant wet coating. The resulting photosensitive layer may preferably have a thickness of 5–40 μm, more preferably 15–30 μm.

In the present invention, it is also possible to add an antioxidant and/or a lubricant to the surface layer of the photosensitive member.

The support of the photosensitive member may comprise any electroconductive material and may be formed in a sheet shape or a cylindrical shape. Examples of the electroconductive material may include metals such as aluminum and stainless steel; and metals, paper and plastics each provided with an electroconductive layer.

In the present invention, between the support and the photosensitive layer, it is possible to dispose an electroconductive layer to prevent of interference fringes and coating of mars on the support. Such an electroconductive layer may be formed by applying a dispersion of electroconductive powder such as carbon black, metal particles and metal oxide particles in an appropriate binder resin and drying the resultant wet coating. The thus formed electroconductive layer may preferably have a thickness of 5–40 μm, particularly 10–30 μm.

Furthermore, in the present invention, an intermediate layer having an adhesion function and a barrier function may be disposed between the support and the photosensitive layer or between the electroconductive layer and the photosensitive layer, as desired. Examples of a material for the intermediate layer may include polyamide, polyvinyl alcohol, polyethylene oxide, ethyl cellulose, casein, polyurethane and polyether-urthane. These materials may be applied in a solution in an appropriate solvent. The thus formed intermediate layer may preferably have a thickness of 0.05–5 μm, particularly 0.3–1 μm.

The electrophotographic photosensitive member according to the present invention can be applied to not only an ordinary electrophotographic copying machine but also to a laser beam printer, a light-emitting diode (LED) printer, a cathode-ray tube (CRT) printer, a liquid crystal printer, and other fields of applied electrophotography including, e.g., laser plate making.

Hereinbelow, an embodiment of an electrophotographic apparatus including a process cartridge using the photosensitive member according to the present invention will be explained with reference to the sole FIGURE.

The FIGURE shows a schematic structural view of such an electrophotographic apparatus of the invention. Referring to the FIGURE, a photosensitive drum (i.e., photosensitive member) 1 according to the present invention is rotated about an axis 2 at a prescribed peripheral (process) speed in the direction of an arrow a shown inside of the photosensitive drum 1. The surface of the photosensitive drum 1 is uniformly charged by a primary charging means (charger) 3 to have a prescribed positive or negative potential during the rotation. The photosensitive drum 1 is image-exposed to light L (as by slit exposure or laser beam-scanning exposure) by using an image exposure means (not shown) in a step of image-exposure, whereby an electrostatic latent image corresponding to an exposure image is successively formed on the surface of the photosensitive drum 1. The thus formed electrostatic latent image is developed by a developing means 5 to form a toner image in a step of developing. The developed toner image is successively transferred to a transfer(-receiving) material 7 which is supplied from a supply part (not shown) to a position between the photosensitive drum 1 and a transfer means (charger) 6 in synchronism with the rotation of the photosensitive drum 1, by means of the transfer means 6. The transfer material 7 with the transferred toner image thereon is separated from the photosensitive drum 1 to be conveyed to an image-fixing means 8, followed by image fixing to print out the transfer material 7 as a copy outside the electrophotographic apparatus. Residual toner particles on the surface of the photosensitive drum 1 after the transfer are removed by a cleaning means (cleaner) 9 to provide a cleaned surface, and residual charge on the surface of the photosensitive drum 1 is erased by pre-exposure light 10 emitted from a pre-exposure means (not shown) to prepare for the next cycle. When the primary charging means 3 is a contact charging means using a charging roller etc., the pre-exposure step may be omitted as desired.

In the electrophotographic apparatus, it is possible to provide a process cartridge which includes plural means selected from the photosensitive member (photosensitive drum) 1, the primary charging means 3, the developing means 5, the cleaning means 9, etc. so as to be detachably mountable to a main body of the apparatus. The process cartridge may, for example, be composed of the photosensitive member 1 and at least one means selected from the group consisting of the primary charging means 3, the developing means 5 and the cleaning means 9 to prepare a single unit capable of being attached to or detached from the main body of the electrophotographic apparatus by using a guiding means such as rails 12 in the apparatus body.

In the case where the electrophotographic apparatus is used as a copying machine or a printer, image-exposure light 4 may be provided by reading a data on reflection light or transmitted light from an original or by reading a data on the original by means of a sensor, converting the data into a signal and then effecting a laser beam scanning, a drive of LED array or a drive of a liquid crystal shutter array so as to expose the photosensitive member surface to the light 4.

Hereinbelow, the present invention, will be explained more specifically with reference to examples. In the following, "part(s)" means "weight part(s)".

EXAMPLE 1

On an aluminum cylinder (30 mm (diameter)×254 mm (width)), a 15 μm-thick electroconductive layer was formed by applying a coating liquid composed of a mixture of the following ingredients by dip coating, followed by hot curing for 30 min. at 140° C.

| Ingredients | part(s) |
|---|---|
| $SnO_2$-coated barium sulfate (electroconductive pigment) | 10 |
| Titanium oxide (resistance-controlling pigment) | 2 |
| Phenolic resin (binder resin) | 6 |
| Silicone oil (leveling agent) | 0.001 |
| Methanol/methoxypropanol (¼) (solvent) | 20 |

On the electroconductive layer, a solution of 3 parts of N-methoxymethylated nylon and 3 parts of a copolymer nylon in a mixture solvent of 65 parts of methanol and 30 parts of n-butanol was applied by dip coating, followed by drying to obtain a 0.5 μm-thick intermediate layer.

A coating liquid for a charge generation layer was prepared by mixing 4 parts of oxytitanium phthalocyanine (showing four main peaks at bragg angles (2θ±0.2 degree) of 9.0 degrees, 14.2 degrees, 23.9 degrees and 27.1 degrees in X-ray diffraction pattern based on CuKα characteristic X-ray), 2 parts of a polyvinyl butyral ("S-LEC BM2", mfd. by Sekisui Kagaku Kogyo K.K.) and 60 parts of cyclohexanone in a sand mill using 1 mmϕ-glass beads for 4 hours and by adding 100 parts of ethyl acetate to the mixture.

The thus prepared coating liquid was applied onto the intermediate layer by dipping and dried to form a 0.3 μm-thick charge generation layer.

A coating liquid for a charge transport layer was prepared by dissolving a mixture of 7 parts of a bisphenol Z-type polycarbonate ("IUPILON Z200", mfd. by Mitsubishi Gas Kagaku K.K; Mv=ca. 20,000 ("another binder B"), 3 parts of the siloxane polymer prepared in Synthesis Example 1 ("siloxane polymer A"), 9 parts of a triarylamine compound of the formula:

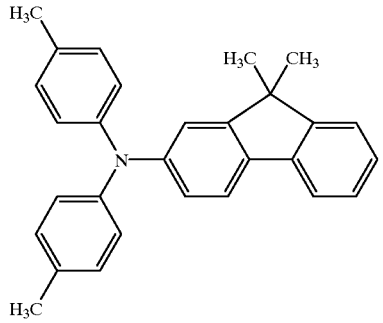

and 1 part of styryl compound of the formula:

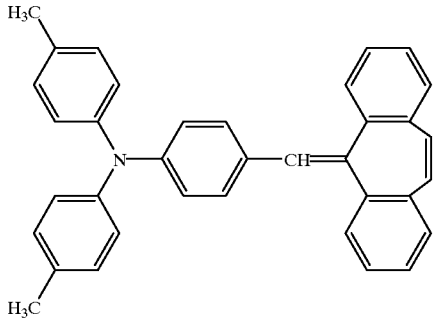

in a mixture solvent of 50 parts of monochlorobenzene and 50 parts of dichloromethane.

The thus prepared coating liquid was applied onto the charge generation layer by dipping, followed by drying for 1 hour at 120° C. to form a 23 μm-thick charge transport (surface) layer, resulting in an electrophotographic photosensitive member.

The thus prepared photosensitive member was installed in a process cartridge for a laser beam printer ("Laser Jet 4 Plus", mfd. by Hewlett-Packard Company).

Before setting the process cartridge in a main body of the laser beam printer, a developing device and a primary charging roller were detached from the process cartridge and instead, a driving motor and a torque meter were attached to a driving portion of the photosensitive member, followed by a measurement of the initial torque value at an ordinary process speed (94 cm/sec).

In this regard, a smaller torque value means a higher lubricity of the photosensitive member (surface) against a cleaning blade.

After the measurement, the above-modified process cartridge was restored to its original condition and installed in the laser beam printer, followed by a halftone-image formation test of 3000 sheets (A4-sized) in an environment of 32° C. and 85% RH to evaluate an abrasion degree at prescribed stages (after 1000 sheets, 2000 sheets and 3000 sheets) and an image quality (a degree of image defects) after the image formation test by eye observation.

The abrasion degree was measured of an eddy-current thickness meter ("Permascope Type E111", mfd. by Fisher Co.).

Furthermore, after the image formation test, a torque value was measured in the same manner as the initial torque value.

The results are shown in Table 1.

EXAMPLE 2

A photosensitive member was prepared and evaluated in the same manner as in Example 1 except that the addition amount of the polycarbonate (another binder B) was changed to 9.5 parts and that of the siloxane polymer (siloxane polymer A) was changed to 0.5 part.

The results are shown in Table 1.

EXAMPLES 3–7

Each of photosensitive members was prepared and evaluated in the same manner as in Example 1 except that the siloxane compound of the formula (4-1) for the siloxane polymer was changed to those shown in Table 1.

The results are shown in Table 1.

EXAMPLE 8

A photosensitive member was prepared and evaluated in the same manner as in Example 3 except that the polycarbonate (another binder B) was not used and the addition amount of the siloxane polymer (siloxane polymer A) was changed to 10 parts.

The results are shown in Table 1.

EXAMPLE 9

Each of photosensitive members was prepared and evaluated in the same manner as in Example 1 except that the siloxane polymer was changed to the siloxane polymer prepared in Synthesis Example 2.

The results are shown in Table 1.

EXAMPLES 10–14

Each of photosensitive members was prepared and evaluated in the same manner as in Example 9 except that the siloxane compound of the formula (4-11) for the siloxane polymer was changed to those shown in Table 1.

The results are shown in Table 1.

EXAMPLE 15

A photosensitive member was prepared and evaluated in the same manner as in Example 14 except that the addition amount of the polycarbonate (another binder B) was charged to 9 parts and the addition amount of the siloxane polymer (siloxane polymer A) was changed to 1 part.

The results are shown in Table 1.

EXAMPLE 16

A photosensitive member was prepared and evaluated in the same manner as in Example 12 except that the polycarbonate (another binder B) was not used and the addition amount of the siloxane polymer (siloxane polymer A) was changed to 10 parts.

The results are shown in Table 1.

EXAMPLE 17

A photosensitive member was prepared and evaluated in the same manner as in Example 16 except that the siloxane polymer was changed to a siloxane polymer obtained from a siloxane compound of the formula (4-19) and a bisphenol compound of the formula (5-16).

The results are shown in Table 1.

EXAMPLES 18 AND 19

Each of photosensitive members was prepared and evaluated in the same manner as in Example 9 except that the siloxane polymer (siloxane polymer A) and the polycarbonate (another binder B) were changed to those shown in Table 1, respectively.

The results are shown in Table 1.

In Table 1, Pc-A represents a bisphenol A-type polycarbonate (Mv=ca. 20,000) and Pc-C represents a bisphenol C-type polycarbonate (Mv=ca. 20,000).

TABLE 1

| Ex. | Siloxane polymer (A) | | | Another binder*1 | A/B | Torque (kg) | | Abrasion degree (μm) | | | |
|---|---|---|---|---|---|---|---|---|---|---|---|
| No. | Siloxane | Bisphenol | Mv (× 10,000) | (B) | (wt. ratio) | Initial | After the test | After 1000 sheets | After 2000 sheets | After 3000 sheets | Image*2 |
| 1 | 4-1 | 5-13 | 2.2 | Pc-Z | 3/7 | 0.9 | 1.6 | 1.5 | 2.8 | 4.3 | A |
| 2 | 4-1 | 5-13 | 2.2 | Pc-Z | 0.5/9.5 | 1.3 | 2.0 | 1.3 | 2.4 | 3.9 | A |
| 3 | 4-3 | 5-13 | 3.0 | Pc-Z | 3/7 | 1.0 | 1.9 | 1.6 | 3.0 | 4.5 | A |
| 4 | 4-4 | 5-13 | 2.3 | Pc-Z | 3/7 | 1.0 | 2.0 | 1.6 | 3.0 | 4.5 | A |
| 5 | 4-6 | 5-13 | 2.7 | Pc-Z | 3/7 | 1.0 | 1.9 | 1.7 | 3.2 | 4.7 | A |
| 6 | 4-8 | 5-13 | 2.2 | Pc-Z | 3/7 | 0.9 | 2.0 | 1.7 | 3.2 | 4.7 | A |
| 7 | 4-9 | 5-13 | 2.6 | Pc-Z | 3/7 | 1.0 | 1.8 | 1.7 | 3.2 | 4.7 | A |
| 8 | 4-3 | 5-13 | 3.0 | — | 10/0 | 0.7 | 1.0 | 1.8 | 3.6 | 4.8 | A |
| 9 | 4-11 | 5-13 | 2.5 | Pc-Z | 3/7 | 1.5 | 1.5 | 1.2 | 2.4 | 3.6 | A |
| 10 | 4-13 | 5-13 | 2.6 | Pc-Z | 3/7 | 1.6 | 1.6 | 1.2 | 2.4 | 3.6 | A |
| 11 | 4-15 | 5-13 | 2.2 | Pc-Z | 3/7 | 1.6 | 1.6 | 1.2 | 2.4 | 3.6 | A |
| 12 | 4-16 | 5-13 | 2.7 | Pc-Z | 3/7 | 1.6 | 1.6 | 1.2 | 2.3 | 3.5 | A |
| 13 | 4-17 | 5-13 | 3.0 | Pc-Z | 3/7 | 1.6 | 1.6 | 1.2 | 2.4 | 3.5 | A |
| 14 | 4-21 | 5-13 | 2.5 | Pc-Z | 3/7 | 1.7 | 1.7 | 1.1 | 2.2 | 3.4 | A |
| 15 | 4-21 | 5-13 | 2.5 | Pc-Z | 1/9 | 1.8 | 1.8 | 1.1 | 2.2 | 3.4 | A |
| 16 | 4-16 | 5-13 | 2.7 | — | 10/0 | 1.4 | 1.4 | 1.5 | 3.0 | 4.5 | A |
| 17 | 4-19 | 5-16 | 2.4 | — | 10/0 | 1.4 | 1.4 | 1.5 | 3.0 | 4.5 | A |
| 18 | 4-19 | 5-2 | 2.2 | Pc-A | 3/7 | 1.5 | 1.5 | 1.2 | 2.4 | 3.6 | A |
| 19 | 4-20 | 5-10 | 2.6 | Pc-C | 3/7 | 1.5 | 1.5 | 1.2 | 2.4 | 3.6 | A |

*1Pc-A: Bisphenol A-type polycarbonate, Pc-C: Bisphenol C-type polycarbonate, Pc-Z: Bisphenol Z-type polycarbonate
*2Good images with no image defects were obtained after 3000 sheets of copying.

COMPARATIVE EXAMPLE 1

A photosensitive member was prepared and evaluated in the same manner as in Example 1 except that the addition amount of the polycarbonate (in this case, called another binder D) was charged to 10 parts and the siloxane polymer was not used.

The results are shown in Table 2.

COMPARATIVE EXAMPLE 2

A photosensitive member was prepared and evaluated in the same manner as in Example 1 except that the siloxane polymer (siloxane polymer A) was changed to a linear siloxane-based polycarbonate copolymer (Mv=ca. 30,000) represented by the following formula (i) (siloxane polymer C).

The results are shown in Table 2.

(i)

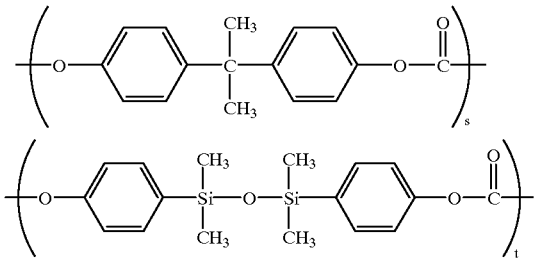

s/t = 0.8/0.2.

COMPARATIVE EXAMPLE 3

A photosensitive member was prepared and evaluated in the same manner as in Comparative Example 2 except that the addition amount of the polycarbonate (another binder D) was charged to 5 parts and the addition amount of the linear siloxane-based polycarbonate copolymer (siloxane polymer C) was changed to 5 parts.

The results are shown in Table 2.

COMPARATIVE EXAMPLE 4

A photosensitive member was prepared and evaluated in the same manner as in Comparative Example 2 except that the polycarbonate (another binder D) was not used and the addition amount of the linear siloxane-based polycarbonate copolymer (siloxane polymer C) was changed to 10 parts.

The results are shown in Table 2.

TABLE 2

| Comp. Ex. No. | Siloxane polymer (C) Mv (× 10,000) | Another binder*1 (D) | C/D (wt. ratio) | Torque (kg) Initial | Torque (kg) After the test | Abrasion degree (μm) After 1000 sheets | Abrasion degree (μm) After 2000 sheets | Abrasion degree (μm) After 3000 sheet | Image*2 |
|---|---|---|---|---|---|---|---|---|---|
| 1 | — | Pc-Z | 0/10 | 3.0 | 3.0 | 1.5 | 3.0 | 4.5 | B |
| 2 | 3.0 | Pc-Z | 3/7 | 2.1 | 2.8 | 1.7 | 3.2 | 4.7 | B |
| 3 | 3.0 | Pc-Z | 5/5 | 1.8 | 2.5 | 1.9 | 3.6 | 4.2 | B |
| 4 | 3.0 | — | 10/0 | 1.8 | 1.8 | 2.0 | 4.0 | 6.0 | C |

*1Pc-Z: Bisphenol Z-type polycarbonate
*2B: Image defects due to the surface mars were observed.
C: Noticeable image defects due to the surface mars were observed.

What is claimed is:

1. An electrophotographic photosensitive member, comprising: a support and a photosensitive layer disposed on the support, wherein said photosensitive member has a surface layer comprising a siloxane polymer which comprises at least two polysiloxane units each independently represented by a formula (1) shown below and has a molecular structure such that adjacent two polysiloxane units of the formula (1) are connected with each other at their side chains by —O—Pc—CO—O— where Pc denotes a polycarbonate chain:

(1)

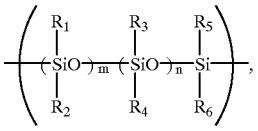

wherein $R_1$, $R_2$, $R_5$ and $R_6$ independently denote hydrogen, halogen, substituted or unsubstituted alkyl group, or substituted or unsubstituted aryl group;

$R_3$ and $R_4$ independently denote hydrogen, halogen, substituted or unsubstituted alkyl group, substituted or unsubstituted aryl group, or a divalent group represented by the following formula (2):

(2)

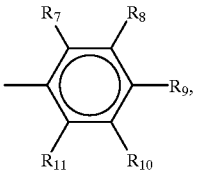

wherein $R_7$ to $R_{11}$ independently denote a single bond, hydrogen, halogen, substituted or unsubstituted alkyl group, or substituted or unsubstituted aryl group; one of $R_7$ to $R_{11}$ being a single bond and at least one of $R_3$ and $R_4$ groups connected with $(SiO)_n$ being said divalent group of the formula (2); and m and n independently denote a positive integer.

2. A member according to claim 1, wherein said polycarbonate chain Pc has a recurring unit represented by the following formula (3):

(3)

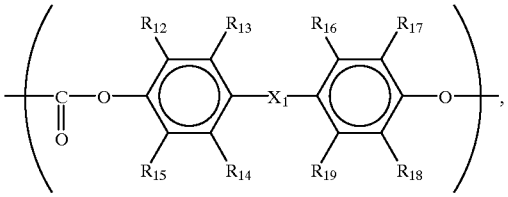

wherein $X_1$ denotes a single bond, —O—, —S—, or substituted or unsubstituted alkylidene group; and $R_{12}$ to $R_{19}$ independently denote hydrogen, halogen, substituted or unsubstituted alkyl group, or substituted or unsubstituted aryl group.

3. A member according to claim 1, wherein said siloxane polymer comprises a product obtained from a siloxane compound represented by a formula (4) shown below, a bisphenol compound represented by a formula (5) shown below, and phosgene:

(4)

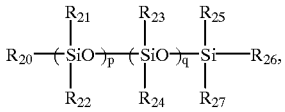

wherein $R_{20}$ to $R_{27}$ independently denote hydrogen, halogen, substituted or unsubstituted alkyl group, or substituted or unsubstituted aryl group, at least one of $R_{23}$ and $R_{24}$ groups connected with $(SiO)_q$ being substituted or unsubstituted phenyl group having hydroxyl group, and p and q independently denote a positive integer; and (5)

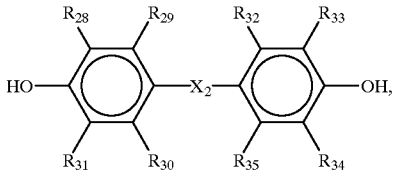

wherein $X_2$ denotes a single bond, —O—, —S—, substituted or unsubstituted alkylidene group; and $R_{28}$ to $R_{35}$ independently denote hydrogen, halogen, substituted or unsubstituted alkyl group, or substituted or unsubstituted aryl group.

4. A member according to claim 1, wherein said surface layer further comprises a polycarbonate resin.

5. A member according to claim 4, wherein said polycarbonate resin has a recurring unit represented by the following formula (6):

(6)

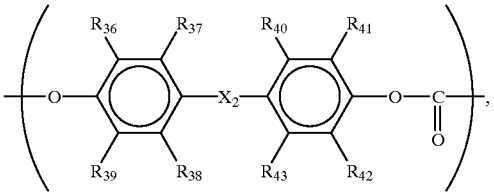

wherein $X_3$ denotes a single bond, —O—, —S—, substituted or unsubstituted alkylidene group; and $R_{36}$ to $R_{43}$ independently denote hydrogen, halogen, substituted or unsubstituted alkyl group, or substituted or unsubstituted aryl group.

6. A process cartridge detachably mountable to an electrophotographic apparatus main body, comprising: an electrophotographic photosensitive member and at least one means selected from the group consisting of charging means, developing means and cleaning means, wherein said electrophotographic photosensitive member, comprises a support and a photosensitive layer disposed on the support, and said photosensitive member has a surface layer comprising a siloxane polymer which comprises at least two polysiloxane units each independently represented by a formula (1) shown below and has a molecular structure such that adjacent two polysiloxane units of the formula (1) are connected with each other at their side chains by —O—Pc—CO—O— where Pc denotes a polycarbonate chain:

(1)

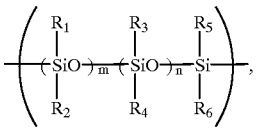

wherein $R_1$, $R_2$, $R_5$ and $R_6$ independently denote hydrogen, halogen, substituted or unsubstituted alkyl group, or substituted or unsubstituted aryl group;

$R_3$ and $R_4$ independently denote hydrogen, halogen, substituted or unsubstituted alkyl group, substituted or unsubstituted aryl group, or a divalent group represented by the following formula (2):

(2)

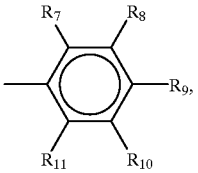

wherein $R_7$ to $R_{11}$ independently denote a single bond, hydrogen, halogen, substituted or unsubstituted alkyl group, or substituted or unsubstituted aryl group; one of $R_7$ to $R_{11}$ being a single bond and at least one of $R_3$ and $R_4$ groups connected with $(SiO)_n$ being said divalent group of the formula (2); and m and n independently denote a positive integer.

7. An electrophotographic apparatus, comprising: an electrophotographic photosensitive member, charging means, exposure means, developing means and transfer means, wherein said electrophotographic photosensitive member, comprises a support and a photosensitive layer disposed on the support, and said photosensitive member has a surface layer comprising a siloxane polymer which comprises at least two polysiloxane units each independently represented by a formula (1) shown below and has a molecular structure such that adjacent two polysiloxane units of the formula (1) are connected with each other at their side chains by —O—Pc—CO—O— where Pc denotes a polycarbonate chain:

(1)

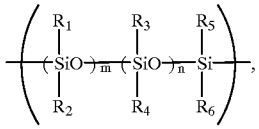

wherein $R_1$, $R_2$, $R_5$ and $R_6$ independently denote hydrogen, halogen, substituted or unsubstituted alkyl group, or substituted or unsubstituted aryl group;

$R_3$ and $R_4$ independently denote hydrogen, halogen, substituted or unsubstituted alkyl group, substituted or unsubstituted aryl group, or a divalent group represented by the following formula (2):

(2)

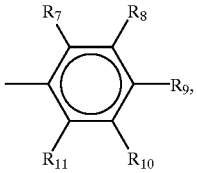

wherein $R_7$ to $R_{11}$ independently denote a single bond, hydrogen, halogen, substituted or unsubstituted alkyl group, or substituted or unsubstituted aryl group; one of $R_7$ to $R_{11}$ being a single bond and at least one of $R_3$ and $R_4$ groups connected with $(SiO)_n$ being said divalent group of the formula (2); and m and n independently denote a positive integer.

* * * * *

UNITED STATES PATENT AND TRADEMARK OFFICE

CERTIFICATE OF CORRECTION

PATENT NO. : 6,093,515

DATED : July 25, 2000

INVENTOR(S) : AKIRA YOSHIDA ET AL.

It is certified that error appears in the above-identified patent and that said Letters Patent is hereby corrected as shown below:

COLUMN 2:

Line 22, "of-toner" should read --of toner--.

COLUMN 3:

Line 39, "FIGURE" should read --figure--; and
Line 59, "therefor" should be deleted.

COLUMN 4:

Line 42, "cyclohexylidene" should read --a cyclohexylidene--.

UNITED STATES PATENT AND TRADEMARK OFFICE

CERTIFICATE OF CORRECTION

PATENT NO. : 6,093,515

DATED : July 25, 2000

INVENTOR(S) : AKIRA YOSHIDA ET AL.

It is certified that error appears in the above-identified patent and that said Letters Patent is hereby corrected as shown below:

COLUMN 7:

Line (4-11),

" (4-11) "

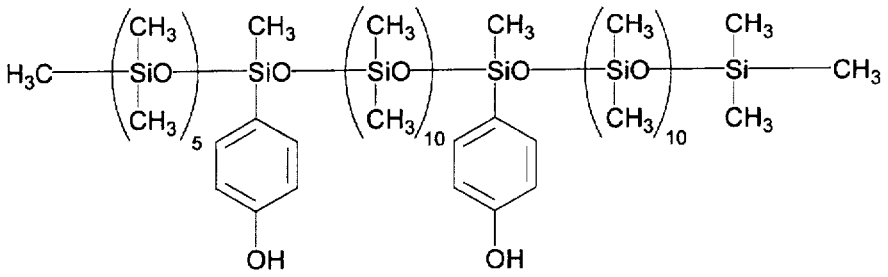

should read (4-11)

-- 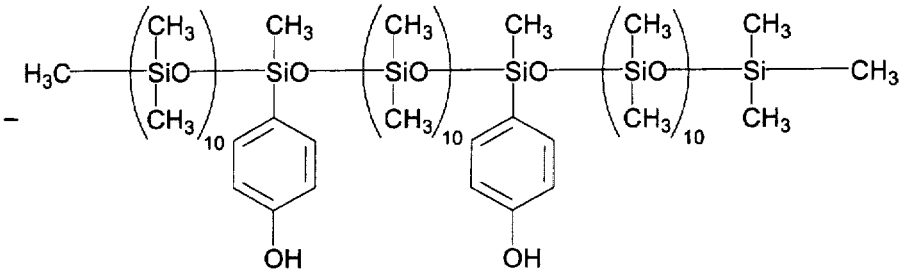 --.

COLUMN 17:

Line 11, "thereto," should be deleted;
Line 23, "ether" should read --the ether-- and
"confirmed in the" should read --observed at--; and
Line 24, "position of" should be deleted.

UNITED STATES PATENT AND TRADEMARK OFFICE

CERTIFICATE OF CORRECTION

PATENT NO. : 6,093,515

DATED : July 25, 2000

INVENTOR(S) : AKIRA YOSHIDA ET AL.

It is certified that error appears in the above-identified patent and that said Letters Patent is hereby corrected as shown below:

COLUMN 19:

Line 52, "accordingly" should read --accordingly,--.

COLUMN 24:

Line 40, "of" should be deleted.

COLUMN 25:

Line 57, "a" should be deleted; and
Line 59, "the" (2nd occurrence) should be deleted.

COLUMN 27:

Line 41, "an" should be deleted;
Line 43, "of" should read --by--; and
Line 56, "that" should read --the amount--.

COLUMN 28:

Line 31, "charged" should read --changed--.

COLUMN 30:

Line 39,"charged" should read --changed--.

UNITED STATES PATENT AND TRADEMARK OFFICE

CERTIFICATE OF CORRECTION

PATENT NO. : 6,093,515

DATED : July 25, 2000

INVENTOR(S) : AKIRA YOSHIDA ET AL.

It is certified that error appears in the above-identified patent and that said Letters Patent is hereby corrected as shown below:

COLUMN 33:

Line "

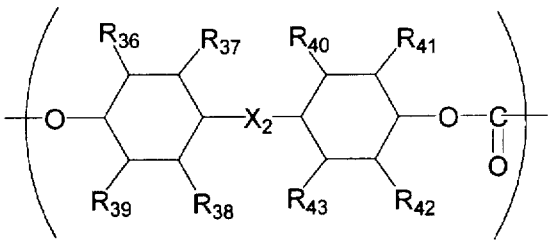

" should read

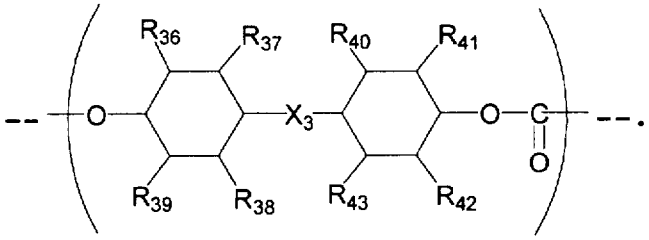

--.

Signed and Sealed this

Eighth Day of May, 2001

*Attest:*

NICHOLAS P. GODICI

*Attesting Officer*

*Acting Director of the United States Patent and Trademark Office*